United States Patent [19]

Norman et al.

[11] 4,379,746

[45] Apr. 12, 1983

[54] METHOD OF DESTRUCTION OF POLYCHLORINATED BIPHENYLS

[75] Inventors: Oscar L. Norman, Wilmington, Del.; Laurence H. Handler, Cherry Hill, N.J.

[73] Assignee: Sun-Ohio, Inc., Canton, Ohio

[21] Appl. No.: 274,928

[22] Filed: Jun. 18, 1981

Related U.S. Application Data

[63] Continuation of Ser. No. 179,345, Aug. 18, 1980, abandoned, which is a continuation of Ser. No. 99,341, Nov. 30, 1979, abandoned.

[51] Int. Cl.[3] ..... C10G 29/04

[52] U.S. Cl. ..... 208/262; 210/712; 210/737; 210/757; 210/909; 210/719

[58] Field of Search ..... 208/179, 181, 182, 262; 210/757, 766, 909, 712, 719, 737, 668, 669; 556/400, 450; 570/204; 585/469

[56] References Cited

U.S. PATENT DOCUMENTS 3,686,337 8/1972 Chang ..... 260/650 R
4,127,598 11/1978 McEntee ..... 556/450

FOREIGN PATENT DOCUMENTS 1917357 5/1970 Fed. Rep. of Germany .
49-82570 8/1974 Japan .

OTHER PUBLICATIONS

The Franklin Institute News, vol. 44, No. 2, Jun.–Jul., 1980.
Oku et al., "A Complete Dechlorination of Polychlorinated Biphenyl by Sodium Naphtnalene", Chemistry and Industry, Nov. 4, 1978, pp. 841–842.
"Sodium Dispersion", Brochure of U.S. Industrial Chemicals Co., pp. 38–39.
Berry R., "Rerefining Waste Oil", Chemical Engineering, Apr. 23, 1979, pp. 104–106.
Chem. Abs. 82:125822u, 1975.
Science News, vol. 116, p. 422.
Parker and Cox, Plant Engineering, Aug. 21, 1980, p. 133.
"A Safe Efficient Chemical Disposal Method for Polychlorinated Biphenyls—PCB's", Goodyear Publication (1980).

*Primary Examiner*—Ivars C. Cintins
*Attorney, Agent, or Firm*—J. Edward Hess; Donald R. Johnson; Paul Lipsitz

[57] ABSTRACT

A field method for removing polychlorinated biphenyls (PCB's) and similar halogenated aromatic hydrocarbons from silicone based oils and hydrocarbon fluids such as transformer oils contaminated with them by contacting the contaminated oil with a hydrocarbon dispersion of sodium, reacting the mixture of oil and sodium dispersion at a temperature above about 75° C., and passing the treated oil through a filter medium or other separating means to remove particulate and other contaminating material.

11 Claims, 1 Drawing Figure

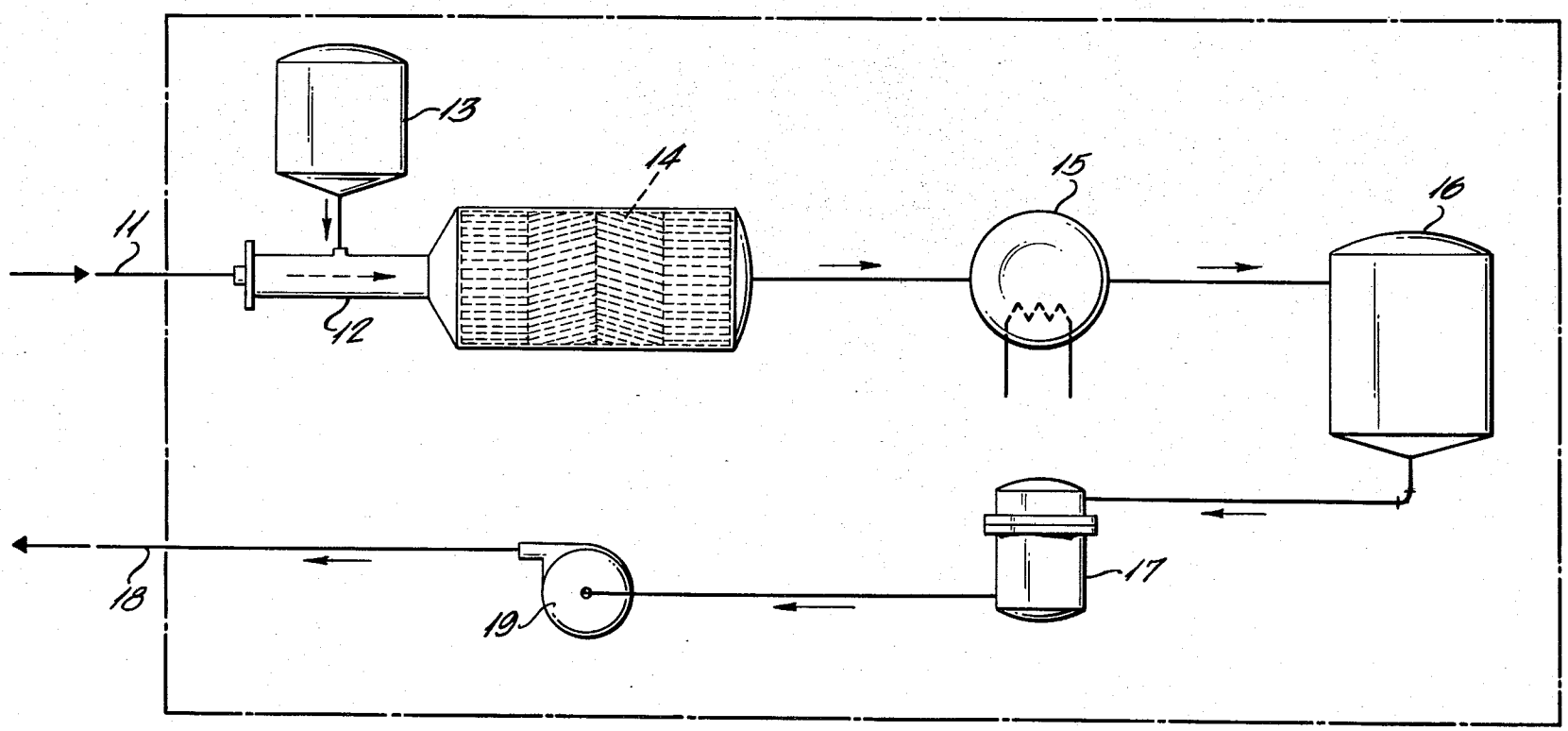
16
15
14
13
12
11
17
19
18

METHOD OF DESTRUCTION OF POLYCHLORINATED BIPHENYLS

CROSS REFERENCE TO RELATED APPLICATION

This is a continuation of Ser. No. 179,345 filed Aug. 18, 1980 which is a continuation of Ser. No. 99,341, filed Nov. 30, 1979, both now abandoned.

As is well known, polyhalogenated biphenyls such as polychlorobiphenyls (PCB's) and polybromobiphenyls (PBB's) are toxic materials whose use has been curtailed for environmental reasons. Because of their thermally stable and nonflammable properties PCB's have been used as dielectric materials for transformers, capacitors, and as heat transfer agents, and the like. Although the PCB's and PBB's used heretofore have, in many cases, been replaced with different nonhazardous materials, these replacement materials have frequently been contaminated with residual PCB's or PBB's remaining in the equipment. Thus, for example, when large transformers containing PCB's are drained and the liquid dielectric replaced with an environmentally acceptable dielectric (usually a hydrocarbon or silicone based oil) the new material becomes contaminated with residual PCB's which were not removed by the replacement procedure.

Such transformer oils, heat transfer agents, and the like are frequently serviced in the field at the point of use by mobile equipment which removes accumulated foreign matter in the oil and otherwise refines it for reuse in the system from which it is removed. Since many of such oils contain contaminating PCB's or PBB's it is desirable that the service in the field be able to remove them in an economical and expeditious manner.

It is known that sodium dispersions and high-surface sodium are useful in eliminating impurities such as halides from petroleum fractions and other hydrocarbons (U.S.I. Industrial Chemicals Co. brochure "Sodium Dispersions"). Sodium naphthalene has also been used to dechlorinate polychlorinated biphenyls as disclosed by Akira Oku, et al. (Chemistry and Industry, Nov. 4, 1978). Generally the procedures employed are batch techniques at a fixed site and do not lend themselves to field processing.

The present invention is directed to a field method for removing polyhalogenated aromatic compounds for hydrocarbon and silicone oils by contacting the contaminated oil with a sodium dispersion, reacting the mixture at a temperature above about 75° C., and separating particulate and other unwanted material.

It is believed that the reaction results in the polyhalogenated aromatic compounds being converted to innocuous polyaromatic compounds. In a preferred process the contaminated oil is passed through a conduit equipped with mixing means, a hydrocarbon dispersion of sodium is introduced into the contaminated oil in the conduit at a point to ensure thorough mixing, the mixture of oil and sodium dispersion is reacted at a temperature of at least about 75° C., the treated oil is passed through a filter medium or other separating means to remove particulate and other contaminating material and preferably, the treated oil is recycled to the system from which it was removed. In a further preferred embodiment, any excess sodium remaining after the reaction with the PCB's is removed from the system by reaction with a hydrated absorbent material which is added to the system. The hydrated absorbent reacts with any unreacted sodium and thus, upon discarding the used filter bed no hazardous materials are present and environmental standards are met.

The sodium dispersion used in the process of the invention will be one where the particle size of the sodium particles is preferably on the order of about one to about ten microns. Sodium dispersions where the sodium particle is about twenty microns are operable for the process, but less time efficient. Suitable dispersions are commercially available and are exemplified by Matheson Light Oil Sodium Dispersion. Reference is also made to the text by Fatt and Tashima entitled "Alkali Metal Dispersions," D. Van Nostrand Company, Inc., New York, 1961, which describes the preparation of these dispersions in detail.

The amount of sodium dispersion used in the system depends upon the concentration of the PCB or PBB contaminants and other sodium reactive materials present. Prior to performing the process, the contaminated oil is analyzed for the PCB's (or PBB's), water and acid number by conventional analytical procedures. The results of such analysis provide a basis for calculation as to how much sodium is needed to react stoichiometrically with the sodium-reaction components present, and usually a small sodium excess of about 10% will be actually used. Since the flow rate of the oil through the system will be controlled to be from about 5 to about 25 gallons per minute as determined by the particular oil being treated, the rate of addition of the sodium dispersion to the contaminated oil can readily be determined.

As indicated, the method of the invention is continuous and will employ an apparatus similar to that shown in the drawing. The transformer oil or other system oil to be treated is taken through line 11 to a conduit 12 and the appropriate amount of sodium dispersion under slight nitrogen pressure or by other positive displacement is metered into the conduit from dispersion storage tank 13. The mixture of oil and dispersion then proceeds through the conduit to a mixing zone 14 which may be a stirred agitator, or preferably an interfacial surface generator mixing device exemplified by the types disclosed in U.S. Pat. Nos. 2,747,844; 3,195,865; 3,394,924; and 3,632,090. These static mixers are preferred as they have no moving parts, require no maintenance or power, are compact, and can form an integral part of the conduit system. The drawing shows the mixed fluid then entering a heating zone 15 in order to ensure essentially complete reaction of the halogen compound with the sodium metal in the dispersion. However, the heating zone may be positioned at other locations; e.g. in the mixing stage or even before the introduction of the sodium dispersion. All that is required is that the mixture of sodium dispersion and oil be heated to a temperature above about 75° C. for reaction to occur and completion of the reaction. In general, the temperature of the reaction mixture will be between about 100° and about 150° C. Preferably, the operating temperature of the process will be between about 120° C. and about 150° C. and still more preferably a temperature of about 125° C. to about 130° C. The reacted fluid then passes to a holding zone 16 from which it flows to a separator such as a filter system 17. The filter system will use as the filter medium any one of a number of filtering media including Fuller's earth, alumina, attapulgus clay, paper, and the like. It will be understood that the particulate material is separated by filtration, but other unwanted materials may be removed by sorption phenomena. The filtered oil which is clear and water white or slightly colored is then ready for reuse and after cooling is returned to the transformer or other system through line 18. Pump 19 is shown as a means to effect circulation of the liquid through the system.

The entire system described above is easily mounted on a pallet or flat bed truck and is readily transported to the site where the hydrocarbon oil is to be treated. Thus, a highly effective, efficient and cost-effective means is provided for purifying oil contaminated with polyhaloaromatic compounds and a valuable advance in the art has been achieved.

It is of interest to note that high surface sodium on alumina is somewhat effective, but inefficient to remove PCB's to a sufficiently low level. Only the sodium dispersion as described is sufficiently effective, and then only above about 75° C., as below this temperature, PCB's removal does not occur efficiently.

In order to further illustrate the invention, the following examples are given.

EXAMPLE 1

Following the procedures discussed above, a relatively clean hydrocarbon oil contaminated with PCB's containing 49.2 ppm of chlorine is treated for fifteen minutes with an excess over the stoichiometric amount of sodium dispersion having sodium particles of one micron in size at 120° to 125° C. and passed through a ten-inch column of a one-inch diameter bed of Fuller's earth. Five successive runs are made using the same previously used Fuller's earth bed. The following table indicates the analytical results which are obtained on the product liquid.

TABLE I

| Run | ppm Chlorine | ppm Sodium | Color |
|---|---|---|---|
| 1 | — | <0.1 | Colorless |
| 2 | 1.3 | <0.1 | Colorless |
| 3 | — | <0.1 | Colorless |
| 4 | — | <0.1 | Colorless |
| 5 | 1.0 | <0.1 | Colorless |

It is to be noted that the colorless product liquid is low in both chlorine and sodium. The chlorine analysis in this example and all others following were carried out by the Dohrmann microcoulometric method. The analytical blank with an uncontaminated hydrocarbon based transformer oil was normally 0.8–1.8 ppm Cl.

EXAMPLE 2

Following the procedure as discussed above, a very dirty transformer oil contaminated with PCB's containing 40.7 ppm of chlorine is treated with an excess over the stoichiometric amount of a sodium dispersion having sodium particles of one micron at 120° to 125° and passed through a ten-inch column of a one-inch in diameter bed of Fuller's earth absorbent. The product oil obtained is colorless, has a power factor of 0.0017 at 100° C., a resistivity of $64\times10^{12}$ ohm-cm at 100° C. and contains 2.6 ppm of chlorine and less than 0.1 ppm of sodium. When the run is repeated and the sodium treated material passed through the previously used Fuller's earth, the product liquid is light yellow and contains 8.0 ppm of chlorine and 2.6 ppm of sodium. A third passing of treated material through the Fullers's earth yields a cloudy, orange liquid, thus indicating the need to replace the filter material when a highly impure oil is treated.

EXAMPLE 3

This example shows the effect of temperature and is carried out with a test oil and sodium dispersion as in Example 1. Table II shows the results obtained.

TABLE II

| Temperature (°C.) | Time (Min.) | Cl (ppm) |
|---|---|---|
| 73–75 | 15 | 25.9 |
| 100–105 | 15 | 30.9 |
| 120–125 | 5 | 4.6 |
| 120–125 | 15 | 1.0 |

Thus it is clear from the above that at the operating temperatures a greater reduction in chlorine is obtained for a given reaction time.

EXAMPLE 4

This example illustrates the use of a "High Surface" sodium dispersed on alumina for PCB's removal and the effect of residence time.

A standard test hydrocarbon oil containing PCB's analyzing for 49.2 ppm chlorine is heated to 105° to 110° C. and passed through a bed of alumina containing high surface sodium. The data for this run is shown in Table III.

TABLE III

| Sample # | Residence Time (Min.) | ppm Chlorine | ppm Sodium |
|---|---|---|---|
| 1 | 8.8 | 1.3 | <1.0 |
| 2 | 8.8 | 1.5 | |
| 3 | 8.8 | 2.4 | |
| 4 | 4.3 | 9.5 | |
| 5 | 4.3 | 10.6 | 3.0 |
| 6 | 4.3 | 6.6 | |
| 7 | 1.6 | 34.7 | |
| 8 | 1.6 | 31.0 | 6.0 |

Although the "High Surface" sodium removes the chlorine content, Stoichiometric calculation of the data in Table IV shows that with continuing throughput the system does not efficiently reduce the PCB content of the oil even at a temperature of 120°–125°.

TABLE IV

High Surface Sodium PCB Removal Process

Bed: 10% $Na/Al_2O_3$ (28–48 mesh, 12g-Na, 120g-$Al_2O_3$)
Feed: Test Oil containing 49 ppm Cl (PCB's)

| Sample No. | Flow Rate (ml/Min.) | Total Volume Flow at Sample (ml) | Chlorine ppm | Approximate PCB Content of Treated Oil |
|---|---|---|---|---|
| Oil Temperature: 74–77° C. | | | | |
| 1 | 8 | 255 | 17.0 | 34.0 |
| 2 | 10 | 530 | 24.0 | 48.0 |
| 3 | 17 | 784 | 36.6 | 73.2 |
| Oil Temperature: 100–110° C. | | | | |
| 1 | 17 | 284 | 1.3 | 2.6 |
| 2 | " | 403 | 1.5 | 3.0 |
| 3 | " | 522 | 2.4 | 4.8 |
| 4 | 35 | 857 | 9.5 | 19.0 |
| 5 | " | 992 | 10.6 | 21.2 |
| 6 | " | 1127 | 6.6 | 13.2 |
| 7 | 95 | 1477 | 34.7 | 69.4 |
| 8 | " | 1727 | 31.9 | 63.8 |
| 9 | 17 | 2811 | 13.6 | 27.2 |
| Oil Temperature: 120–125° C. | | | | |
| 1 | 17 | 180 | 7.0 | 14.0 |
| 2 | " | 527 | 2.9 | 5.8 |

TABLE IV-continued

High Surface Sodium PCB Removal Process

Bed: 10% $Na/Al_2O_3$ (28–48 mesh, 12g-Na, 120g-$Al_2O_3$)
Feed: Test Oil containing 49 ppm Cl (PCB's)

| Sample No. | Flow Rate (ml/Min.) | Total Volume Flow at Sample (ml) | Chlorine ppm | Approximate PCB Content of Treated Oil |
|---|---|---|---|---|
| 3 | " | 985 | 1.8 | 3.6 |
| 4 | " | 1994 | 2.1 | 4.2 |
| 5 | " | 2760 | 2.7 | 5.4 |
| 6 | " | 3075 | 2.1 | 4.2 |
| 7 | " | 3380 | 8.1 | 16.2 |
| 8 | " | 3690 | 13.2 | 26.4 |
| 9 | " | 4764 | 25.0 | 50.0 |

EXAMPLE 5

Using the technique of Example 1 at 100° C. with PCB contaminated oil (40.7 ppm chlorine) and with a sodium dispersion where the particle size is 20 microns, the following Table V shows the inefficiency of the process with such sodium particle size:

TABLE V

| Time (Min.) | ppm Chlorine |
|---|---|
| 5 | 36.9 |
| 10 | 29.7 |
| 15 | 27.0 |

EXAMPLE 6

When Example 1 is repeated but using alumina, Filtrol ® 24 and Florosil ® as absorbent beds, a reduction in PCB's is similarly obtained, but in most cases the product is somewhat colored. With both Filtrol 24 and Florosil the beds are quite effective, but are quickly plugged. Thus these absorbents are less desirable than Fuller's earth.

EXAMPLE 7

When Example 1 is repeated with a silicone based transformer oil contaminated with PCB's, the chlorine content is similarly reduced to low levels of chlorine.

As indicated above in another embodiment of the invention the separation procedure involves reacting a hydrated absorbent material with the treated product taken from holding tank 16 in order to remove any sodium particles still present. Thus an absorbent such as a hydrated silica or silicate may be added to the product from the holding tank, agitated thoroughly while being held for a short time (about 1 to 5 minutes) and filtered through an industrial filter before passing through filter 17. In this way, the excess unreacted sodium particles react with the water in the hydrated absorbent and this permits easier filtration and gives a cleaner product. In an alternative method, the hydrated absorbent may simply be used alone as the filter media or placed in the bed of a different filter material; i.e. the hydrated material may be a bottom, middle or top layer in the filter bed of non-hydrated filter medium used in filtering the treated oil. Other examples of hydrated absorbents include finely divided RVM and LVM (partially hydrated) types of attapulgus clay (mesh size of 200/up made by Engelhard Industries) and hydrated magnesium silicate (Britesorb ® 90 made by Philadelphia Quartz Company). This embodiment is illustrated by the following examples.

EXAMPLE 8

As in Example 1, 100 ml of test oil containing about 50 ppm of chlorine from PCB's present is treated with 20 drops of a sodium dispersion in light oil (1 micron particle size) for fifteen minutes at 120°–125° C. Then, one gram of finely divided hydrated silica (HiSil ® 233 made by PPG Industries) is added to the hot oil, stirred for three to four minutes and allowed to stand for 45 minutes while cooling. The material is then filtered through a paper filter to give a water white oil product containing less than 1 ppm of sodium, less than 1 ppm of chlorine and less than 10 ppm of silicon.

When a dirty oil is used in the above example (90 ml of the oil of Example 1 plus 10 ml of a used, dirty transformer oil) the results are essentially the same except that the filtered oil has a slight yellow color.

With a very dirty oil under the same conditions the resulting filtered oil is a deep orange and contains 2.8 ppm of chlorine, 116 ppm of sodium and less than 1 ppm of silicon.

When Example 8 is repeated with the test oil but using one gram of 200/Up attapulgus clay instead of the hydrated silica, the resultant oil is water white. With a dirty oil, two grams of the attapulgus clay gives a clear oil with an orange color.

EXAMPLE 9

A test oil containing 49 ppm of chlorine is treated with a sodium dispersion as in Example 8 and is passed through a column of 50/80 mesh RVM type attapulgus clay. The resulting oil is clear and water white and greatly reduced in chlorine content.

EXAMPLE 10

A run is made similar to that of Example 9, but using a column composed of a top one-third layer of RVM attapulgus clay and a lower two-thirds layer of LVM attapulgus clay (both clays of 50/80 mesh). The oil effluent is somewhat hazy due to the presence of water and/or clay fines, but the chlorine content of the treated oil is reduced from 49 ppm to 9.3 ppm. A test of the oil with litmus paper indicates that it is neutral. When water is present in the oil it is readily removed by vacuum stripping before reuse. However, by using a larger amount or a more efficient hydrated absorbent, the oil may be treated without any water breaking through.

EXAMPLE 11

A transformer fluid containing 379 ppm of PCB's is removed from its transformer container and is circulated at 8.5 gallons per minute through a truck mounted treating system. The oil is heated to 140° C. in a heating zone and after passing through a mixing zone, a sodium dispersion of 40% by weight sodium (predominantly 1 to 10 microns) in a light oil is added at the rate of 82 ml per minute. In this way a total of 300 gallons of oil is treated with 6.5 pounds of the sodium dispersion. The heated oil is maintained at reaction temperature for about 15 minutes and is then passed through an Attapulgus clay filter and, after vacuum stripping the dissolved gases, moisture or light ends, it has cooled to about 75° C. and is returned to the transformer with less than 4 ppm of PCB's in it.

EXAMPLE 12

Following essentially the same procedure of Example 11, 245 gallons of a transformer oil containing 408 ppm of PCB's is similarly heated at 150° C. with 9.5 pounds of sodium dispersion added at a rate of 117 ml per minute. The treated oil which is returned to the transformer contains less than 4 ppm of PCB's.

The invention claimed is:

1. A field method to remove at the point of use, halogenated aromatic hydrocarbons from hydrocarbon transformer oils contaminated with said halogenated aromatic hydrocarbons which comprises removing said contaminated oil from the transformer and circulating said oil through a decontamination system at a flow rate of from about 5 to about 25 gallons per minute to effect decontamination by mixing the contaminated oil with a hydrocarbon dispersion of sodium wherein said sodium has a particle size of from about one to about twenty microns, reacting the mixture of oil and sodium dispersion at a temperature above about 75° C. up to about 150° C., passing the treated oil through separating means to remove particulate and other contaminating material and returning the treated oil essentially free of halogenated aromatic hydrocarbons back to the transformer.

2. The method of claim 1 wherein the temperature is from about 125° C. to about 150° C.

3. The method of claim 1 wherein the particle size of the sodium is from about 1 to about 10 microns.

4. A field method for removing polychlorinated biphenyls from hydrocarbon transformer oil contaminated with said biphenyls which comprises removing said contaminated oil from the transformer at the point of use and circulating said oil through a decontamination system at a flow rate of from about 5 to about 25 gallons per minute to effect decontamination by mixing the contaminated oil with a hydrocarbon dispersion of sodium wherein said sodium has a particle size of from about one to about twenty microns, reacting the mixture of oil and sodium dispersion at a temperature of about 120° C. up to about 150° C., passing the treated oil through a filter medium to remove particulate and other contaminating material and returning the heated oil essentially free of polychlorinated biphenyls to said transformer.

5. A field method for removing polyhalogenated biphenyls from hydrocarbon transformer oil contaminated with said biphenyls which comprises removing said contaminated oil from the transformer at the point of use and circulating said oil through a decontamination system at a flow rate of from about 5 to about 25 gallons per minute to effect decontamination by mixing the contaminated oil with a hydrocarbon dispersion of sodium wherein said sodium has a particle size of from about one to about twenty microns, reacting the mixture of oil and dispersion at a temperature from about 120° C. to about 150° C., reacting the sodium particles remaining in the treated oil with a hydrated absorbent material, separating particulate and other contaminating material, and returning the treated oil essentially free of polyhalogenated biphenyls back to the transformer.

6. The method of claim 5 wherein the halogenated biphenyls are polychlorinated biphenyls.

7. The method of claim 6 wherein the temperature is from about 125° to about 130° C.

8. The method of claim 7 wherein the particle size of the sodium is from about 1 to about 10 microns.

9. The method of claim 8 wherein the hydrated absorbent is a hydrated silica.

10. The method of claim 8 wherein the hydrated absorbent is a attapulgus clay.

11. The method of claim 8 wherein the hydrated absorbent is a hydrated magnesium silicate.

* * * * *